United States Patent [19]

Shipp

[11] Patent Number: 4,958,855

[45] Date of Patent: Sep. 25, 1990

[54] PHOTO FINISHER WALLET

[75] Inventor: Robert D. Shipp, Bel Air, Calif.

[73] Assignee: Rembrandt Photo Services, Los Angeles, Calif.

[21] Appl. No.: 310,308

[22] Filed: Feb. 13, 1989

[51] Int. Cl.[5] ..... B42D 7/00

[52] U.S. Cl. ..... 281/45; 281/31; 281/51; 150/147

[58] Field of Search ..... 281/15 R, 31, 33, 22, 281/23, 38, 15.1, 45, 51; 40/158.1, 159, 159.1, 530, 536, 537, 388, 405; 150/131, 132, 147; 206/45.34, 455, 456

[56] References Cited

U.S. PATENT DOCUMENTS

| | | | |
|---|---|---|---|
| 2,732,875 | 1/1956 | Martin | 150/147 |
| 2,815,126 | 12/1957 | Deckers | 150/147 |
| 2,828,975 | 4/1958 | Wright | 150/147 |
| 2,850,294 | 9/1958 | Ortis et al. | 281/31 |
| 2,878,850 | 3/1959 | Quint | 150/147 X |

FOREIGN PATENT DOCUMENTS

| | | | |
|---|---|---|---|
| 119324 | 12/1944 | Australia | 150/132 |

OTHER PUBLICATIONS

Pages 4, 5, 6 and 7 of Rembrandt Photo Services, "1988 Minilab Catalog".

Page 8 of Rembrandt Photo Services, "1988 Minilab Catalog".

Page 16 of Rembrandt Photo Services, "1988 Minilab Catalog".

Page 17 of Rembrandt Photo Services, "1988 Minilab Catalog".

Sample "Photo Album-Regal Class", manufactured by Pico-Glass (1987).

*Primary Examiner*—Paul A. Bell
*Assistant Examiner*—Yu-Chi Lin
*Attorney, Agent, or Firm*—David Weiss

[57] ABSTRACT

A photo finisher wallet or pouch for utilization by a photo finishing laboratory for delivering photographic prints and corresponding negatives to a customer, as well as for storing the prints and negatives, and in addition for permitting some or all of the prints to be displayed by means of leaves having transparent pockets in the manner of a photo album. The photo finisher wallet comprises a flexible cover sheet foldable along a middle portion for forming a folder having a front cover and a rear cover; cover pocket means on the inner surface of at least one of the covers for storing stacked photographic prints; and a plurality of leaves, each leaf affixed along an edge to the cover sheet middle portion and contained within the covers when the cover sheet is folded, each leaf including transparent leaf pocket means for displaying at least one of the prints removed from the cover pocket means and inserted in the leaf pocket means.

17 Claims, 3 Drawing Sheets

Fig. 1.
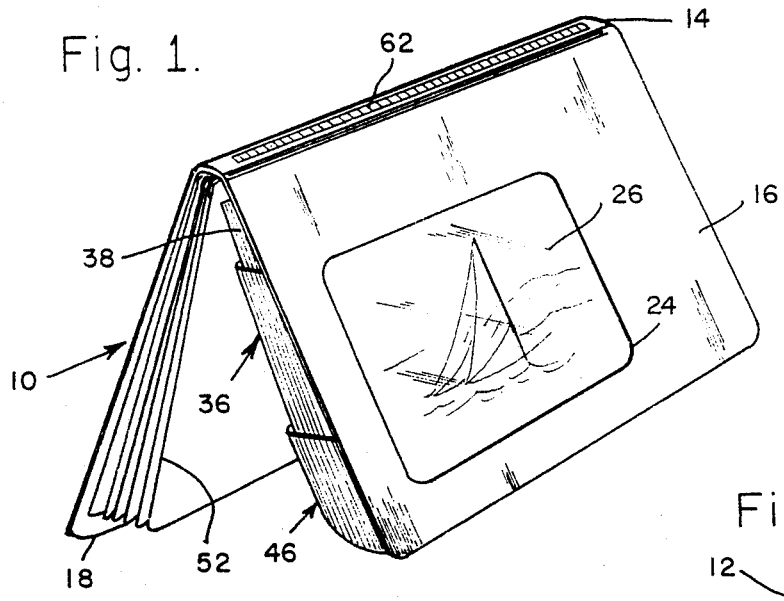
Fig. 3.
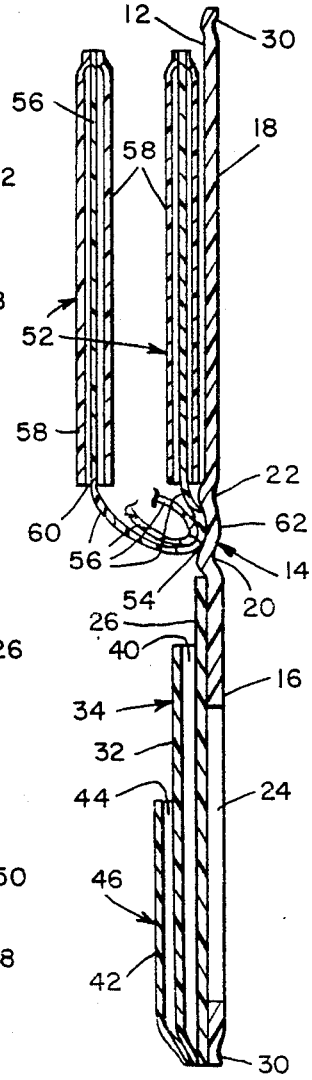
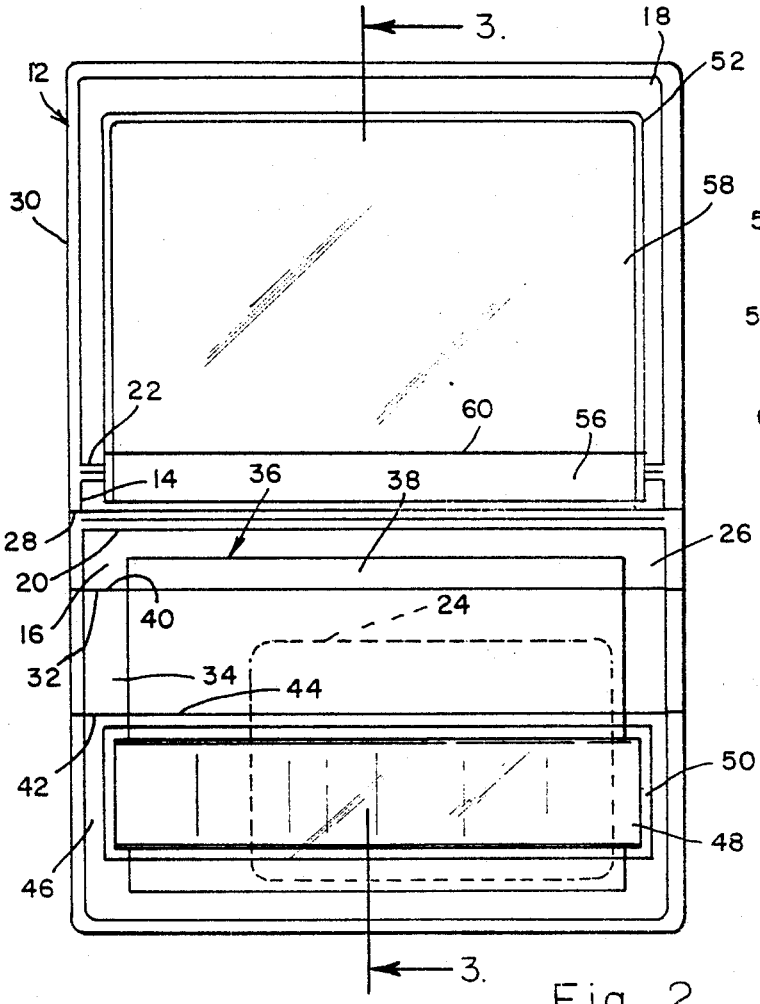
Fig. 2.

PHOTO FINISHER WALLET

BACKGROUND OF THE INVENTION

This invention relates to packaging for photographic prints and transparencies by a photo finishing laboratory, and in particular to a photo finisher wallet or pouch.

Most non-professional photographers do not themselves process their exposed camera film or produce prints therefrom, but instead entrust these activities to a photo finishing laboratory. Typically, the customer delivers his exposed film to the photo finisher who in due course returns to the customer a package containing the finished photographic prints and their corresponding negatives.

The type of package delivered by the photo finisher is normally a paper envelope upon which the customer's name and processing/printing instructions are noted, and an inner print wallet or pouch containing a stack of the finished photographic prints and another stack of the corresponding negatives usually as film strips within a protective sleeve.

One popular type of photo finisher wallet or pouch is constructed of a flexible sheet material such as vinyl, which is foldable along a middle portion to form a folder having a front cover and a rear cover. Each cover is larger in each dimension than the corresponding dimensions of the photographic prints, and one of the covers includes a pocket on its inner surface into which the stack of prints may be inserted. The sleeved film strips may be inserted in the same pocket, or a separate pocket for accommodating the film strips may be on the inner surface of the other cover, or the film strip pocket may be situated upon the print pocket. In any case, each pocket is formed by a panel of flexible material affixed along three of its edges to a cover's inner surface, normally with the pocket's opening parallel to and directed toward the folder's middle portion.

Such photo finisher wallets may be rectangular, and are typically designed to accommodate as many as thirty-six prints having dimensions up to 4 inches by 6 inches. The wallet when unfolded may have overall dimensions of approximately 7¼ inches by 9⅝ inches, the foldable middle portion may be an approximately one-half inch strip running along the former dimension, and each inside cover pocket opening extending along the same dimension or width. The width of each pocket, which is only slightly shorter than the cover's width, is sufficiently greater than the photographic prints' larger dimension or width to permit the pocket to conform to the stack thickness of the prints and the stacked film strips when inserted in their respective pockets. For example, the width of the print pocket may be approximately one inch greater than the longer dimension of the prints.

After the customer removes and reviews the prints from the photo finisher wallet, he may replace some or all of the prints in the wallet, and the wallet may then be filed for storing the prints and negatives and for subsequent removal and further review. In addition or alternatively, the customer may transfer some or all of the prints to a photographic print album, such as an album containing leaves having transparent pockets for displaying the prints, whereupon the photo finisher wallet may be filed for storing the negatives and certain of the untransferred prints or it may be discarded.

SUMMARY OF THE INVENTION

By means of the present invention, an improved photo finisher wallet or pouch is provided which not only functions in a photo finishing laboratory package for delivering photo prints and their corresponding negatives and for storing the prints and negatives, but in addition permits some or all of the prints to be displayed in the manner of a photo album.

Briefly described, the photo finisher wallet of the present invention comprises, in combination, a flexible cover sheet foldable along a middle portion for forming a folder having a front cover and a rear cover; cover pocket means on the inner surface of at least one of the covers for storing stacked photographic prints; and a plurality of leaves, each leaf affixed along an edge to the cover sheet middle portion and contained within the covers when the cover sheet is folded, each leaf including transparent leaf pocket means for displaying at least one of the prints removed from the cover pocket means and inserted in the leaf pocket means In a preferred embodiment of the photographic print wallet of the present invention, the cover pocket means includes a cover pocket affixed to the inner surface of the front cover and having an opening for inserting the photographic prints therein, and may also include an additional pocket affixed to the inner surface of the front cover upon the print pocket or to the inner surface of the rear cover. The front cover preferably includes viewing means for viewing at least a portion of one of the prints when the stack of prints is stored in the front cover pocket. The cover sheet of the preferred embodiment is opaque and the front cover includes a transparent window therein, or an aperture in the front cover with a flexible transparent panel affixed to the inner surface of the front cover and interposed between the cover pocket and the front cover aperture.

BRIEF DESCRIPTION OF THE DRAWINGS

The novel features which are believed to be characteristic of the invention, together with further advantages thereof, will be better understood from the following description considered in connection with the accompanying drawings in which preferred embodiments of the invention are illustrated by way of example. It is to be expressly understood, however, that the drawings are for the purpose of illustration and description only and are not intended as a definition of the limits of the invention.

FIG. 1 is a perspective view of a preferred embodiment of a photo finisher wallet or pouch according to the present invention, shown partially open.

FIG. 2 is a plan view of the inside of the wallet of FIG. 1, shown fully open, including a stack of photographic prints and a stack of sleeved film strip negatives in place;

FIG. 3 is a cross-sectional view of the wallet shown in FIG. 2, taken along the line 3—3 in the direction of the appended arrows, but without the stack of photographic prints and the film strips in place;

DETAILED DESCRIPTION OF THE PREFERRED EMBODIMENTS

Figure 4:
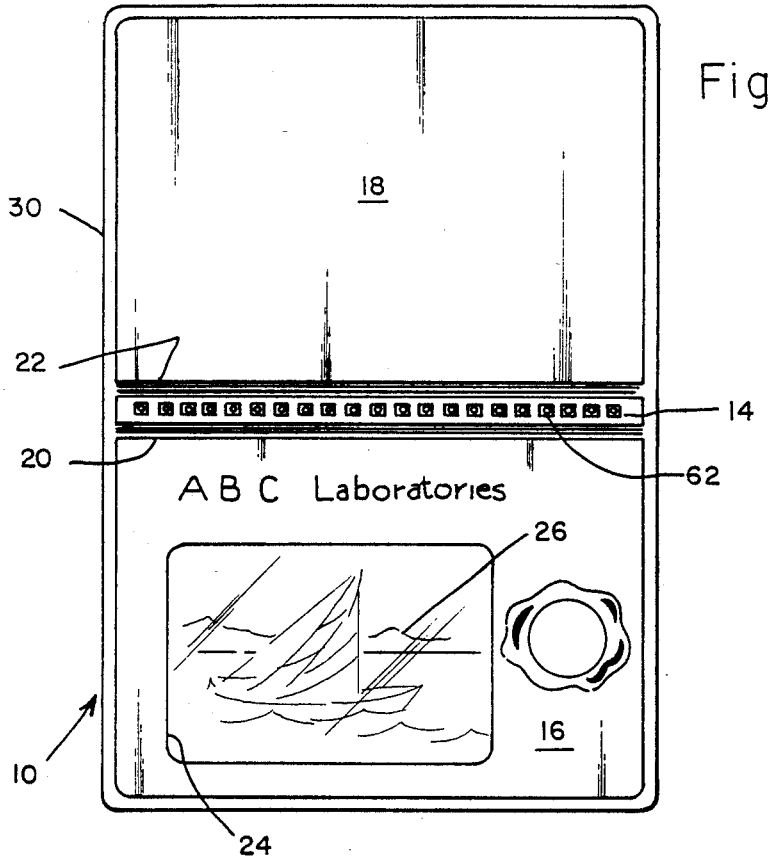
FIG. 4 is a plan view of the outside of the wallet of FIG. 2.

The preferred embodiment of the photo finisher wallet or pouch 10 according to the present invention may be described with reference to FIGS. 1, 2, 3 and 4.

A rectangular flexible sheet, preferably of a thermo-adhesive material such as polyvinyl chloride, or vinyl, which may be of 0.010 inch thickness, is foldable along a middle portion 14 to form a rectangular flexible front cover 16 and a rectangular flexible rear cover 18, as demonstrated in FIG. 1. The middle portion 14 is a strip of the cover sheet 12 bordered by at least one and preferably two parallel fold lines or creases which may be implemented by respective creased bar seals 20, 22 produced by procedures conventional in the materials fabrication art and particularly with respect to thermo-adhesive materials. When the cover sheet 12 is folded along the bar seals 20, 22, one bar seal 20 defines the top edge of the front cover 16 while the other bar seal 22 defines the top edge of the rear cover 18. The rectangular front and rear covers 16, 18 are of substantially equal dimensions.

The front cover 16 is preferably opaque, and includes an aperture 24 therein of substantial size for permitting an observer to view at least a portion of one of the photographic prints when stored within the wallet 10. The aperture 24 may be of any configuration, determined perhaps through considerations of aesthetics, and provides a closed transparent window in the opaque front cover 16 with a transparent flexible panel 26 affixed to the front cover's inner surface. The transparent panel 26 is preferably of a thermo-adhesive material such as clear vinyl and which may be of 0.005 inch thickness, of the same surface dimensions as the front cover 16 so that the panel 26 may be affixed to the inner surface of the front cover 16 along their respective edges by conventional thermo-adhesive techniques. For example, the transparent panel 26 may be heat sealed along its top edge 28 to the inner surface of the front cover 16 by means of the bar seal 20, while the transparent panel 26 may be heat sealed along its remaining three edges to the front cover 16 by means of the peripheral bar seal 30 extending along all four edges of the vinyl cover sheet 12.

A second flexible panel 32, preferably of thermo-adhesive material such as vinyl, and which may be transparent and of 0.005 inch thickness, is affixed to the inner surface of the front cover 16 to form a pocket 34 for storing a stack 36 of photographic prints 38. The second panel 32 is affixed to the inner surface of the front cover 16 such that the pocket 34 which it forms has its unaffixed edge or opening 40 directed toward and extending parallel to the covers' fold, i.e. the fold lines of the middle portion 14 implemented by the bar seals 20, 22 of the preferred embodiment. The remaining three edges of the second panel 32 are affixed to the three free edges of the front cover 16 by conventional thermo-adhesive techniques resulting in the aforementioned peripheral bar seal 30.

Figure 5:
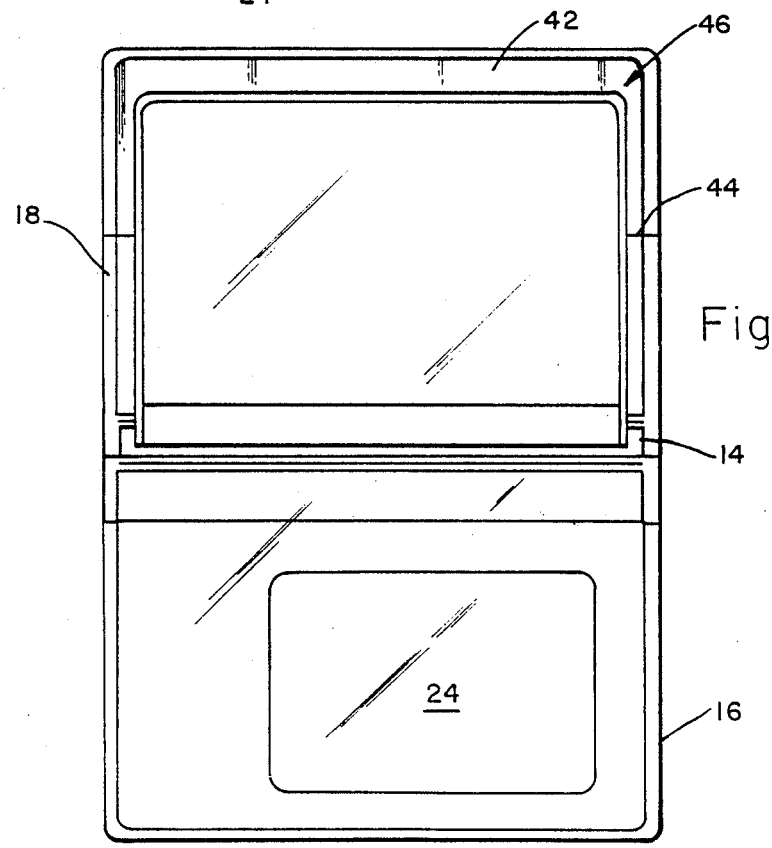
FIG. 5 is a plan view of the inside of a variation of the preferred embodiment of the wallet of FIG. 2.

In its preferred embodiment the wallet 10 includes a third flexible panel 42, preferably of thermo-adhesive material such as vinyl, and which may be transparent and of 0.005 thickness, affixed along three of its edges to the inner surface of the front cover 16 with its unaffixed edge or pocket opening 44 forming a pocket 46 situated upon the photo print pocket 34. Alternatively, the third panel 42 may be affixed in similar manner to the inner surface of the rear cover 18, as shown in FIG. 5, to form the pocket 46. This second pocket 46 is for storing developed film strips of negatives 48 corresponding to photographic prints 38 within the stack 36, the film strips 48 ordinarily being protected by a sleeve 50. The unaffixed edge or opening 44 of the pocket 46 is directed toward and extends parallel to the covers' fold, i.e. the fold lines of the middle portion 14 implemented by the bar seals 20, 22 in the preferred embodiment, and the three remaining edges of the panel 42 forming the pocket 46 are affixed along the three free edges of the front cover 16 as shown in FIGS. 1, 2 and 4, or to the three free edges of the rear cover 18 as shown in FIG. 5, by conventional thermo-adhesive techniques resulting in the peripheral bar seal 30.

The photo finisher wallet of the present invention includes a plurality of leaves 52, each of which is affixed along an edge 54 to the middle portion 14 of the cover sheet 12, as best shown in FIGS. 2 and 3. The leaves 52 may be of conventional construction in the photographic print album leaf art, such as comprising a panel of opaque flexible thermo-adhesive webbing 56 with transparent thermoadhesive panels forming a pair of transparent pockets 58 on each side of the webbing 56, each pair of pockets 58 having respective openings 60 facing one another. The webbing 56 may be affixed to the inner surface of the cover sheet middle portion 14 along a spine area between the facing openings 60 of each pair of pockets 58 by conventional thermo-adhesive techniques to produce a spine 62 along the middle portion 14, parallel to and extending between the creased bar seals 20, 22, as shown in FIGS. 1, 3 and 4. The resulting leaves 52 each have a single transparent pocket 58 on each side of each leaf 52. Each pocket opening 60 is directed toward and extends parallel to the spine 62, or to the fold lines of the cover sheet middle portion 14 implemented by the bar seals 20, 22.

The wallet 10 is used by the photo finisher for packaging photographic prints produced from transparencies such as negatives developed from exposed film received by the photo finishing laboratory, together with the negatives, for delivery to the customer. The photo finisher places a stack 36 of photographic prints 38 in the wallet's print pocket 34, and the negative film strips 48 protected by the sleeves 50 in the film strip pocket 46. The stack 36 of prints 38 is placed in the pocket 34 with the emulsion side of one of the photographic prints 38 in contact with the first flexible transparent panel 26 so that at least a portion of the one of the photographic prints 38 may be viewed through the window 24, as indicated in FIGS. 1 and 4. Normally, the emulsion side of each photographic print 38 of the stack 36 will face the front cover 16 so that the first of the prints 38 in the stack 36 will be in contact with the transparent panel 26 and may be viewed through the window 34.

The wallet 10 need not include a separate film strip pocket 46, in which case the sleeved negatives 48 may be placed in the pocket 34 along with the photographic prints 38, preferably between the last of the prints 38 in the stack 36 and the second flexible panel 32.

After the customer removes the stack 36 of photographic prints 38 from the print pocket 34, he generally reviews each print 38 and may decide to discard some of the prints 38 and retain others of the prints 38. The wallet 10 of the present invention permits the customer, in addition, to display at least some of the prints 38 by inserting them in the transparent pockets 58 of the leaves 52. The number of prints 38 which may be accommodated by the leaves 52 is, of course, dependent upon the number of pockets 58 contained by the leaves 52 within the wallet 10 (or rather the number of leaves 52 since each leaf 52 carries two pockets 58 as previously described), and the number of prints 38 in the stack 36. In its preferred embodiment, the wallet's print pocket 34 will conveniently accommodate a stack 36 of as many as seventy-two prints 38 having dimensions of up to four inches by six inches, while the number of leaves 52 may vary from two to thirty-six for displaying between four and seventy-two prints 38. Preferred numbers of leaves are six (to accommodate twelve prints for display), ten (to accommodate twenty prints for display), or twelve (to accommodate twenty-four prints for display).

Returning specifically to FIG. 2, the dimensions of the preferred embodiment of the wallet 10 are such that a stack 36 of photographic prints 38 which are approximately six inches wide and four inches high may be accommodated. For ease of description, the "width" dimension of components shown in FIG. 2 is established as being parallel to the fold lines or bar seals 20, 22 of the middle portion 14 of the cover sheet 12, or to the spine 62, while the "height" dimension is established as being perpendicular to the bar seals 20, 22 or the spine 62 as viewed in the drawing. Accordingly, the dimensions of the cover sheet 12 are approximately 7⅛ inches in width and approximately 10½ inches in height; the height of the middle portion 14 (i.e. the distance between the two fold lines implemented by the bar seals 20, 22) is approximately ½ inch; and each cover is approximately 7⅛ inches in width by 5 inches in height. The photo print pocket 34 is approximately 6⅞ inches in width and 4 inches in height, while the negatives pocket 46 is the same width and approximately 2½ inches in height to accommodate film strips 48 within their protective sleeves 50 which may be approximately 6½ inches in width and 2⅜ inches in height. Each leaf 52 has dimensions for carrying pockets 58 of sufficient size for accommodating photographic prints 38 which are 6 inches in width and 4 inches in height; each leaf 52 may be 6½ inches in width and 4¾ inches in height, with pockets approximately 6¼ inches in width and 4¼ inches in height. Of course, each of the aforementioned dimensions may be adjusted according to the dimensions of the largest photographic print to be accommodated, and in particular with respect to a wallet according to the present invention for accommodating photographic prints which are 7 inches in width and 5 inches in height.

In one example the configuration of the window 24 is rectangular and is approximately 4¼ inches in width and perhaps 2¾ inches in height. In this example, the rectangular window 24 is located off center both horizontally and vertically, resulting in areas of the outer surface of the front cover 16 which may be imprinted with indicia such as the identity of the photo finisher or other advertisement, for example above and to one side of the window 24 as viewed in FIG. 4. Although the orientation of the cover printing as shown in FIG. 4 indicates that the wallet 10 is intended to be opened with the spine 62 in a relatively horizontal orientation so that the front cover 16 may be flipped upwardly to open the wallet 10 as indicated in FIG. 1, the wallet 10 may be opened and closed sidewise with the wallet 10 held with its spine 62 relatively vertically as viewed in the drawing so that the front cover 16 may open in the manner of a book. In such latter case, any printing on the wallet's front cover 16 will be oriented 90° from the orientation of the printing shown in FIG. 4.

The cover sheet 12 need not comprise a continuous panel of sheet material but may, if desired, comprise a number of panels. For example, each of the covers 16, 18 may be a separate panel, with one of the panels including the middle portion 14, in which case the two panels may be affixed to one another by means of one of the bar seals 20, 22 to form the cover sheet 12. The middle portion 14, further, may be a separate panel, in which case the three panels may be affixed to one another by means of both bar seals 20, 22. In such manner, the two covers 16, 18 and/or the middle portion may be of different colors or degrees of opacity or transparency.

It may be appreciated that the covers 16, 18 of the wallet 10 of the present invention are preferably greater in their height dimension than prior art photo finisher wallets, say by approximately one-half inch, for accommodating the same size photographic prints 38. This additional height permits the presence of a space between the edge of the photographic prints 38 directed toward and parallel to the fold lines of the middle portion 14, or the spine 62, precluding the stack 36 from interfering with the leaves 52 in the vicinity of the spine 62 when the covers 16, 18 are closed.

Figure 6:
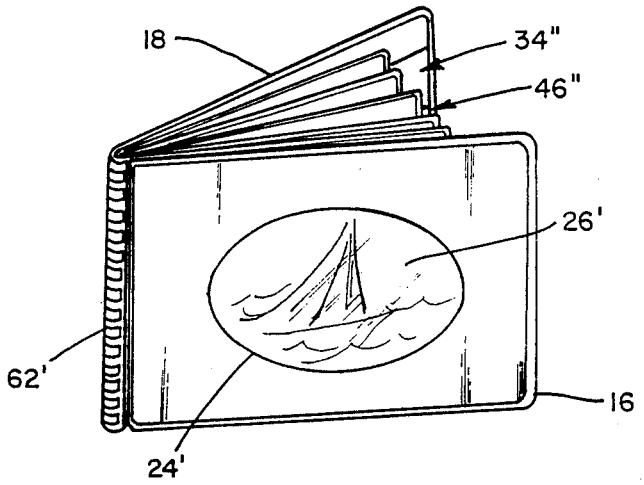
FIG. 6 is a perspective view of an alternative embodiment of a photo finisher wallet according to the present invention, shown partially open.
Figure 7:
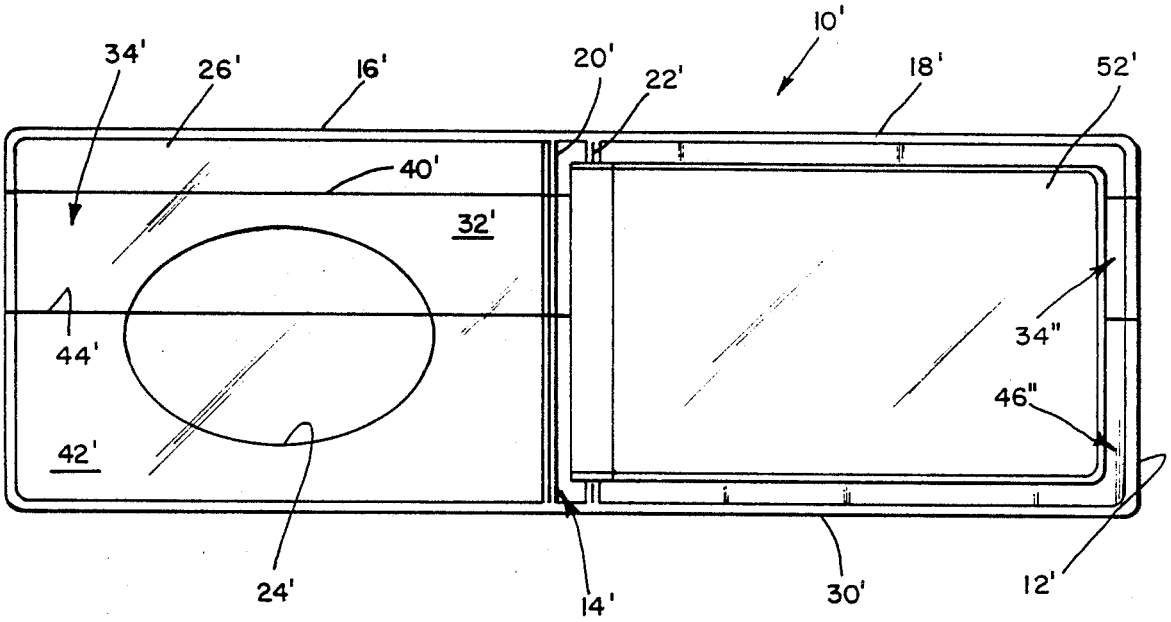
FIG. 7 is a plan view of the inside of the wallet of FIG. 6, shown fully open.

Turning to FIGS. 6 and 7, a second embodiment of a photo finisher wallet or pouch 10″ according to the present invention is shown, wherein primed reference numerals refer to components similar to components of the preferred embodiment 10 having corresponding but unprimed reference numerals. The alternative wallet embodiment 10″ includes front cover pockets 34′, 46′ having their respective pocket openings 40′, 44′ perpendicular to the spine 62′, or to the fold lines implemented by the bar seals 20′, 22′ along the middle portion 14′. The stack of photographic prints may be situated in the print pocket 34′ with the photo prints' longer dimension perpendicular to the spine 62′ or fold lines, and each leaf 52′ is affixed along its shorter edge to the middle portion 14′ to form the spine 62′. The wallet 10′ may include an aperture 24′, which is shown in FIGS. 6 and 7 as being oval but may be of any other desired configuration, to form a transparent closed window with the first flexible transparent panel 26′ which in turn is affixed to the inner surface of the front cover 16′.

In fabricating the wallet 10′, the first transparent panel 26′ may be the same dimensions as the flexible cover sheet 12′ and affixed to the cover sheet along their respective edges by means of the peripheral bar seal 30′, and further affixed by means of the bar seals 20′, 22′. Similarly, the second and third flexible (preferably transparent) panels 32′, 42′ may extend along the entire longer dimension of the cover sheet 12′, and may be affixed to the cover sheet by means of the peripheral bar seal 30′ and the middle portion bar seals 20′, 22′. Accordingly, the inner surface of the front cover 16′ includes thereon a photographic print pocket 34′ and a transparencies or negatives pocket 46′ which is superposed upon a portion of the print pocket 34′. Similarly, the inner surface of the rear cover 18′ includes thereon a second photographic print pocket 34″ and a second transparencies or negatives pocket 46″ superposed upon a portion of the second photographic print pocket 34″.

Thus, there has been described a photo finisher wallet or pouch for utilization by a photo finishing laboratory for delivering photographic prints and the corresponding negatives to a customer, as well as for storing the prints and negatives, and in addition for permitting some or all of the prints to be displayed by means of leaves having transparent pockets in the manner of a photo album. It may be appreciated that the wallet may be utilized for delivering photo prints and other corresponding transparencies such as slides from which the photographic prints were reproduced, and for storing the prints and the slides if desired, and in addition for permitting the photographic prints to be displayed by means of the included leaves. Further, although vinyl has been discussed above as a preferred flexible thermo-adhesive material for fabricating the wallet of the present invention, other thermo-adhesive materials such as polypropylene and polyethylene—as well as other flexible materials which are not thermo-adhesive—may be utilized Other embodiments of the photo finisher wallet of the present invention and the manner in which the wallet may be fabricated, and modifications of the embodiments presented herein, may be developed without departing from the essential characteristics thereof. Accordingly, the invention should be limited only by the scope of the claims listed below.

I claim:

1. A photo finisher wallet for accommodating a stack of at least twelve photographic prints of predetermined dimensions, comprising the combination of:

a flexible cover sheet foldable along a middle portion to form a front cover and a rear cover;

cover pocket means on the inner surface of at least one of said covers for storing the stack of photographic prints; and a plurality of leaves, each leaf of said plurality affixed along an edge thereof to said cover sheet middle portion to form a spine and contained within said covers when said cover sheet is folded, each said leaf including on at least one side thereof a single transparent pocket of approximately said predetermined dimensions occupying approximately the entire area of said leaf and the prints insertable in said pockets, the dimensions of each of said covers being slightly greater than the dimensions of said leaves, and the dimension of said at least one cover perpendicular to said spine being sufficiently greater than the predetermined dimension of the prints perpendicular to said spine when the stack is stored in said cover pocket means and said cover sheet is folded such that the stack is precluded from interfering with said leaves in the vicinity of said spine.

2. The photo finisher wallet according to claim 1, above, wherein said cover pocket means includes means for storing photographic film transparencies corresponding to the prints.

3. The photo finisher wallet according to claim 2, above, wherein said cover pocket means includes a pocket having an opening for inserting therein the stack of prints and the transparencies.

4. The photo finisher wallet according to claim 2, above, wherein said cover pocket means includes a first pocket having an opening for inserting therein the stack of prints, and a second pocket having an opening for inserting therein the transparencies.

5. The photo finisher wallet according to claim 4, above, wherein said first pocket is affixed to the inner surface of one of said covers and said second pocket is affixed to the inner surface of the other of said covers.

6. The photo finisher wallet according to claim 4, above, wherein said first and second pockets are affixed to the same one of said covers.

7. The photo finisher wallet according to claim 6, above, wherein said second pocket is situated upon said first pocket.

8. The photo finisher wallet according to claim 4, above, wherein said first pocket is affixed to the inner surface of said front cover, and said front cover includes viewing means for viewing at least a portion of one of said stack prints when the stack is stored in said first pocket.

9. The photo finisher wallet according to claim 8, above, wherein said cover sheet is opaque and said viewing means includes a transparent window in said front cover.

10. The photo finisher wallet according to claim 9, above, wherein said window includes an aperture in said front cover with a flexible transparent panel affixed to the inner surface of said front cover and interposed between said front cover pocket and said front cover aperture

11. The photo finisher wallet according to claim 1, above, wherein said cover pocket means includes a cover pocket affixed to the inner surface of said front cover and having an opening for inserting therein the stack of prints, and said front cover includes viewing means for viewing at least a portion of one of the prints when the stack is stored in said cover pocket.

12. The photo finisher wallet according to claim 11, above, wherein said cover sheet is opaque and said viewing means includes a transparent window in said front cover.

13. The photo finisher wallet according to claim 12, above, wherein said window includes an aperture in said front cover with a flexible transparent sheet affixed to the inner surface of said front cover and interposed between said front cover pocket and said front cover aperture.

14. The photo finisher wallet according to claim 1, above, wherein the height of said one of said covers is sufficiently greater than the height of the stack when in said cover pocket means such that the stack is precluded from interfering with said leaves in the vicinity of said cover sheet middle portion.

15. The photo finisher wallet according to claim 1, above, further including at least one crease in said cover sheet extending along said middle portion, said cover sheet foldable along said at least one crease.

16. The photo finisher wallet according to claim 1, above, further including at least one crease in said cover sheet along said middle portion, said spine parallel to said at least one crease, said cover sheet foldable along said at least one crease.

17. The photo finisher wallet according to claim 1, above, further including two parallel creases in said cover sheet along said middle portion, said spine parallel to and extending between said creases, said cover sheet foldable along said creases.

* * * * *